US006434809B1

(12) United States Patent
Khurana

(10) Patent No.: US 6,434,809 B1
(45) Date of Patent: Aug. 20, 2002

(54) TOOLING COMPONENT FOR CAMSHAFT REMOVAL AND INSTALLATION

(75) Inventor: Ram B. Khurana, Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/552,435

(22) Filed: Apr. 18, 2000

(51) Int. Cl.[7] ..... B25B 27/14

(52) U.S. Cl. ..... 29/281; 29/278; 29/281.5; 29/888.011

(58) Field of Search ..... 29/888.01, 888.011, 29/402.03, 402.04, 402.08, 426.1, 426.5, 270, 271, 278, 280, 281, 281.5; 74/567; 206/446

(56) References Cited

U.S. PATENT DOCUMENTS

| | | | | |
|---|---|---|---|---|
| 2,317,405 | A | * | 4/1943 | Rutten |
| 3,327,377 | A | * | 6/1967 | German |
| 4,450,609 | A | | 5/1984 | Hamilton |
| 4,894,899 | A | * | 1/1990 | Hamatani |
| 4,996,768 | A | | 3/1991 | Seyller |
| 5,033,177 | A | | 7/1991 | Gathright et al. |
| 5,054,182 | A | | 10/1991 | Riemshield et al. |
| 5,247,737 | A | | 9/1993 | Perry et al. |
| 6,134,765 | A | * | 10/2000 | Ward |

FOREIGN PATENT DOCUMENTS

| | | | |
|---|---|---|---|
| JP | 4-141334 | 5/1992 | ..... B23P/21/00 |

* cited by examiner

*Primary Examiner*—S. Thomas Hughes
*Assistant Examiner*—T. Nguyen
(74) *Attorney, Agent, or Firm*—Woodard, Emhardt, Naughton Moriarty & McNett

(57) ABSTRACT

A kit for both removal of a camshaft from a cylinder block and for installation of a camshaft into a cylinder block includes a minimum of six unitary, molded plastic camshaft guides, an extraction tool, and a pilot to be attached to a rear face of the camshaft in order to provide additional support. Each camshaft guide has a generally C-shaped body and is constructed and arranged to fit onto a corresponding one of the camshaft lobes. Due to the "beyond center" configuration of each camshaft guide, a significant pulling force is required to remove each guide from its corresponding camshaft lobe. Each guide includes an internally-threaded hole which mates with a threaded end on the extraction tool and the extraction tool is used to manually pull each guide off of its corresponding lobe. The pilot includes a generally cylindrical body and a rod inserted therethrough having a threaded tip at one end and an enlarged head at the opposite end. Positioned between the enlarged head and the end face of the body portion are a pair of spacers and O-rings. A tightening nut is used on the threaded end to pull the enlarged head toward the body portion. As this occurs, the O-rings are compressed and expand and this technique is used to wedge the tip portion of the pilot into the hole in the rear face of the camshaft. The camshaft guides protect the camshaft lobes during removal and installation and the pilot provides additional support for the trailing end of the camshaft during removal and the leading edge during installation.

14 Claims, 7 Drawing Sheets

TOOLING COMPONENT FOR CAMSHAFT REMOVAL AND INSTALLATION

BACKGROUND OF THE INVENTION

The present invention relates in general to the removal and installation of a camshaft for a diesel engine. More specifically, the present invention relates to the design and use of tooling components which facilitate the removal of a camshaft from the cylinder block of an engine in a safe and efficient manner. These same tooling components are used when the camshaft which has been removed is to be installed into the cylinder block or when a new camshaft is to be installed into the cylinder block. The removal of a camshaft from its cylinder block is typically performed for repair and/or servicing, and could therefore be performed in the field.

Removal and installation of heavy and/or bulky camshafts in high horsepower diesel engines is an arduous task, particularly during field repairs and/or overhaul. The tooling components which are provided according to the present invention facilitate the removal and installation procedures by providing support to the camshaft and by protecting the precision-machined cam lobes. The result is a faster and safer removal procedure and a faster and safer installation procedure. The added convenience offered by the present invention results in less time being required for the repair and/or overhaul procedures while reducing the risk of damage to the camshaft.

One of the primary tooling components according to the present invention is a contoured PVC sleeve or guide which has a part-circular cross section for fitting over the inner base circle of a corresponding one of the exhaust or intake cam lobes. Another one of the primary tooling components according to the present invention is an aluminum pilot which is designed for attachment to one end of the camshaft by an "expanding screw" in order to provide additional support to the camshaft. Such support is beneficial as the camshaft sequentially passes through the camshaft bearings of the engine cylinder block.

Another one of the tooling components according to the present invention is a guide extractor which is used to facilitate the removal of the guides from the selected camshaft lobes. Since there is a snug fit of the guides onto the inner base circle of each corresponding camshaft lobe, a fair amount of force is required to manually remove the guides. Since there is some risk of hand injury due to the sharp edges which are present, the extractor does the job easily and avoids the risk of injury.

In the context of the present invention, two specific engine styles will be referenced. While it is felt that these specific references will aid in an understanding of the invention, it should be noted that the present invention is applicable to virtually any camshaft, though more applicable to a heavier or heavy-duty camshaft.

SUMMARY OF THE INVENTION

A kit for both removal of a camshaft from a cylinder block and for installation of a camshaft into a cylinder block according to one embodiment of the present invention comprises a kit of tooling components including a plurality of camshaft guides constructed and arranged to fit onto a corresponding one of the camshaft lobes, an extraction tool which is constructed and arranged for connection to each camshaft guide in order to facilitate removal of the plurality of camshaft guides from the corresponding camshaft lobes, and a pilot which is constructed and arranged for connection to a rear face of the camshaft in order to provide additional support. A related embodiment of the present invention includes a method of removing a camshaft from a cylinder block wherein the cylinder block includes a camshaft bore and the method includes the steps of first providing a plurality of camshaft guides which are constructed and arranged to fit onto a corresponding one of the camshaft lobes, providing a pilot which is constructed and arranged to be attached to a rear face of the camshaft, installing the plurality of camshaft guides on the camshaft lobes, sliding the camshaft out of the camshaft bore of the cylinder block, stopping the sliding step when the rear face of the camshaft is accessible by way of a follower opening, installing the pilot flush against the rear face of the camshaft, continuing the sliding step until at least half of the camshaft extends beyond the cylinder block, attaching a lifting strap to the camshaft, resuming the sliding of the camshaft out of the camshaft bore until the camshaft is free of the cylinder block, removing the camshaft guides from the camshaft, and removing the pilot from the rear face of the camshaft.

One object of the present invention is to provide an improved kit of tooling components for both removal and installation of a camshaft.

Another object of the present invention is to provide an improved method for removing a camshaft from and installing a camshaft into a cylinder block.

Related objects and advantages of the present invention will be apparent from the following description.

DESCRIPTION OF THE PREFERRED EMBODIMENTS

Figure 1:
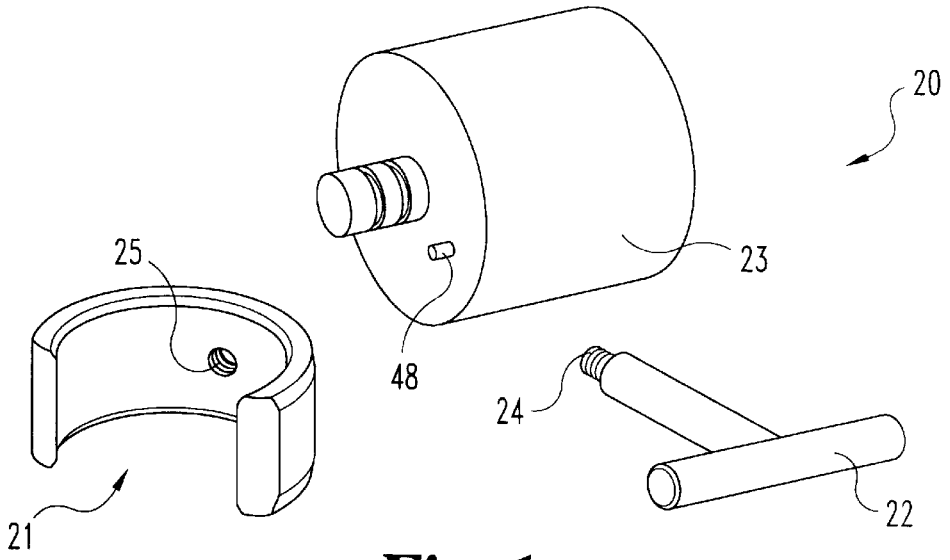
FIG. 1 is a perspective view of a tooling component kit for removal and installation of a camshaft according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, the primary components of a camshaft removal and installation kit 20 are illustrated. Kit 20 includes six camshaft guides 21, only one of which is illustrated, a guide extractor 22, and a support pilot 23. Each guide 21 (see FIGS. 2 and 3) has a smoothly curved, generally C-shape and is designed to snap over the inner base circle of a corresponding camshaft lobe. The guide extractor 22 (see FIG. 4) has a threaded tip 24 in order to assemble into the threaded hole 25 which is located in each guide 21 for manual removal of the guide from the camshaft lobe. The support pilot 23 (see FIG. 5) provides added stability and support to the camshaft during removal and installation procedures. A detailed description of each component part is included as part of the discussion of FIGS. 2–5 which follows.

Figure 2:
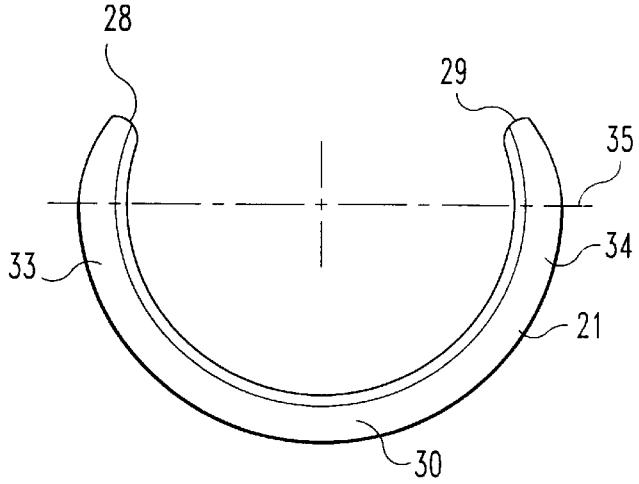
FIG. 2 is a front elevational view of a camshaft lobe guide which comprises one of the tooling components of the FIG. 1 kit.
Figure 3:
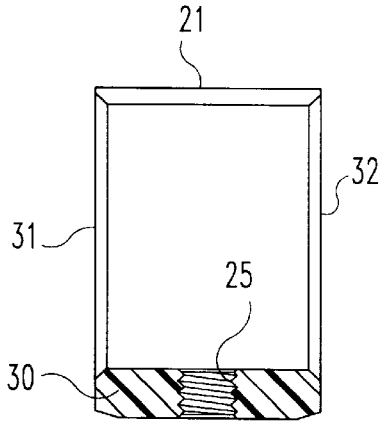
FIG. 3 is a side elevational view in full section of the FIG. 2 guide.

With reference to FIGS. 2 and 3, the C-shaped guide 21 is illustrated. Each guide is a unitary, molded plastic member with a generally cylindrical form which is open between free ends 28 and 29. The threaded hole 25 is centered in base portion 30 equidistant between opposite sides 31 and 32. Side portions 33 and 34 have a radiused curvature and extend upwardly and inwardly beyond diameter centerline 35. This configuration enables each guide 21 to snap onto the inner base circle of a corresponding camshaft lobe and remain in position due to the "beyond center" extent of the side portions 33 and 34. In the preferred embodiment, a PVC material is envisioned for fabrication of guides 21.

Figure 4:
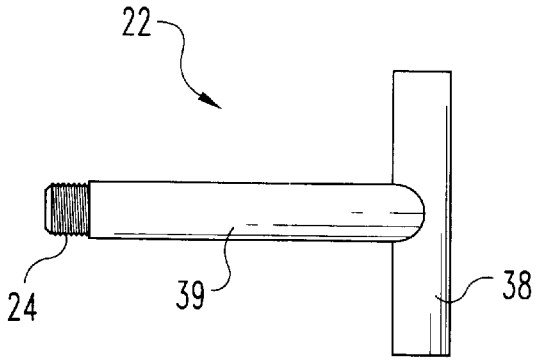
FIG. 4 is a side elevational view of a guide extractor comprising one of the tooling components of the FIG. 1 kit.

With reference to FIG. 4, the extractor 22 is illustrated. Extractor 22 includes a T-handle 38, shaft 39, and externally-threaded tip 24. The thread size and pitch of tip 24 is the same as that of internally-threaded hole 25 located in each guide so that the tip 24 can be securely assembled into each guide hole 25 and thereby enable the extractor 22 to be used for removal of each guide after that guide has been snapped onto a camshaft lobe. The preferred material for extractor 22 is steel.

Figure 5:
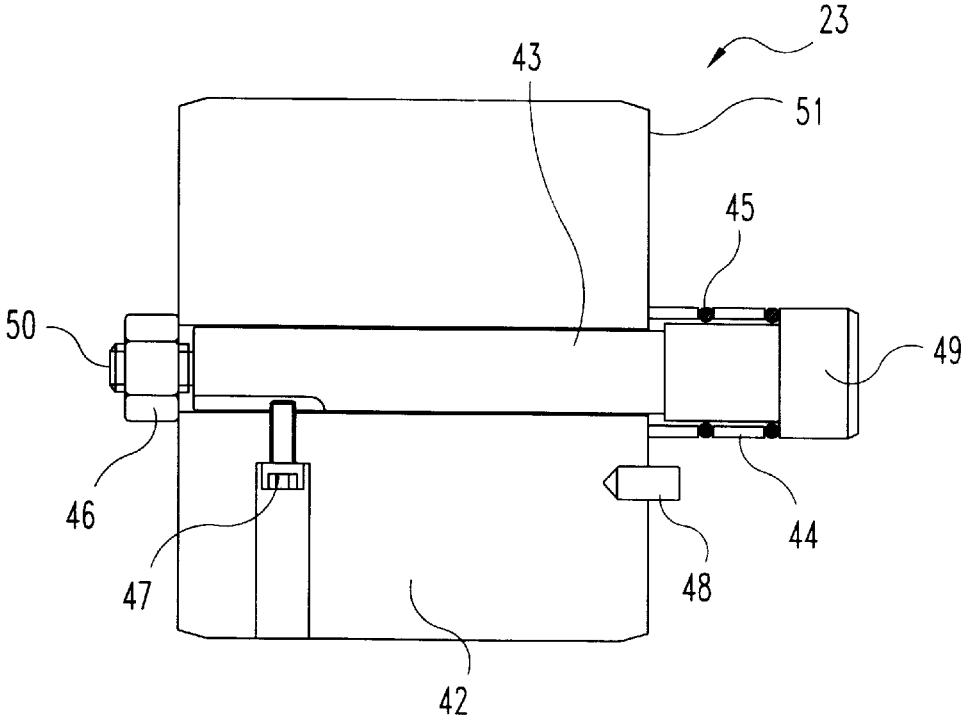
FIG. 5 is a diagrammatic section view of a pilot which comprises one of the tooling components of the FIG. 1 kit.

With reference to FIG. 5, the support pilot 23 is illustrated in diagrammatic, partial section form. Pilot 23 is an assembly of several components including a generally cylindrical body 42, rod 43, two spacers 44, two O-rings 45, threaded hex nut 46, set screw 47, and dowel pin 48. The head 49 of rod 43 is spaced from the body 42 by the two spacers 44 and a pair of O-rings 45. The rod extends through the hollow center of body 42 and the end 50 opposite the head is externally threaded. End 50 extends beyond the body 42 and receives nut 46. Screw 47 is styled as a set screw and functions in this manner. Dowel pin 48 is inserted into the outer face 51 of body 42 and is used as an alignment feature and a "locking" feature to prevent rotation of the pilot when the pilot is attached to the rear face of the corresponding camshaft and anchored in position. The preferred materials for the component parts that comprise pilot 23 include aluminum for the body 42; steel for the rod 43, spacers 44, nut 46, screw 47, and dowel pin 48; and rubber for O-rings 45.

Cummins Engine Company, Inc. of Columbus, Ind., offers a QSK45 series diesel engine and a QSK60 series diesel engine. Each of these diesel engines includes a heavy-duty camshaft. As has been generally discussed, the weight of such heavy-duty camshafts makes it difficult to handle these camshafts in the field at the time of overhaul and repair. The six non-metallic camshaft guides 21 included as part of kit 20 are designed to snap over the camshaft lobes in order to help guide the camshaft through the bushing bores during removal and installation procedures. These guides 21 (in the form of C-clips) are also designed to protect the camshaft lobes from possible damage. In order to provide a frame of reference, each camshaft in engines of this type may be over eight feet long and the removal procedure requires that the camshaft pass through nine different bearing bores. The six guides which are included as part of kit 20 suffice for the desired or requisite degree of protection, though a greater number could be provided as part of the kit. It is not recommended to provide a lesser number than six.

The camshaft guides (C-clips) 21 establish a snug fit over and around the inner base circle of the corresponding camshaft lobes. As a result, a fair amount of force is needed to be able to manually remove the guides after they have been snapped onto the camshaft lobes. Due to the amount of force which is required to manually remove the guides, there is a risk of hand injury as the edges of the cam lobes are sharp. For this reason, the guide extractor 22 has been provided. However, in order to use the guide extractor it will be necessary to rotate the camshaft to bring each guide into a convenient position in order to attach the extractor and from there enable the extractor to be used to pull the guide off of the corresponding lobe.

The removal procedure for servicing a camshaft in the field using kit 20 begins with certain preliminary steps. First, it is important to make certain that the camshaft, camshaft guides, and pilot are free of lubricant and debris. Dirt particles on the inside diameter of the camshaft guides and/or on the camshaft lobes during removal can result in scratching the surface of the camshaft, thereby causing performance degradation or damage to the engine. One of the precautionary notes is to not lubricate the inner diameter of the camshaft guides, but after installing the camshaft guides onto the corresponding camshaft lobes, lubricate the outer diameter with a suitable lubricating substance such as LUBRIPLATE®. As has been described, the camshaft guides 21 are installed on the inner base circle of the selected camshaft lobes, not on the ramp portion of the camshaft lobes.

The next step in the removal process is to carefully examine the camshaft guides for any nicks or burrs and to clean each of the camshaft guides 21 thoroughly before each use. While the kit begins with a total of six guides 21, it has already been explained that a larger number could be provided. Since it is important to repair or replace any damaged camshaft guide, spare guides should be considered as part of the spare parts stocking philosophy.

Set forth below in Table I is a suggestion as to which camshaft lobes should be selected on each camshaft for each of the two engine styles referenced herein.

TABLE I

| QSK45 Camshaft Lobes | | QSK6O Camshaft Lobes | |
|---|---|---|---|
| Left Bank | Right Bank | Left Bank | Right Bank |
| Exhaust - 2, 4, 5, and 6<br>Intake - 2 and 5 | Exhaust - 2, 3, and 5<br>Intake - 2, 3, and 5 | Exhaust - 4, 6, and 8<br>Intake - 2, 4, and 8 | Exhaust - 2, 4, and 7<br>Intake - 2, 3, and 4 |

The suggestions in Table I are for general guidance in order to facilitate the preferred approach to camshaft removal and/or installation. It should also be understood that these particular camshaft lobe selections are tied to the particular camshaft/engine styles which are referenced and that the placement of the camshaft guides can be selectively changed in order to suit existing conditions as well as different camshaft and engine configurations.

Figure 6:
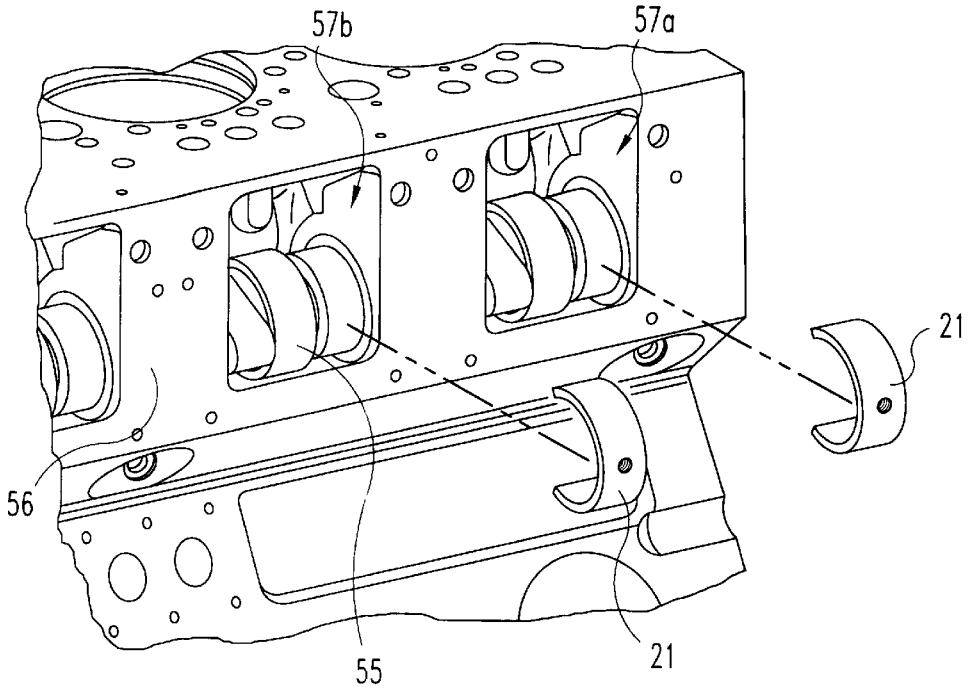
FIG. 6 is a partial, perspective, diagrammatic view of a cylinder block and camshaft in position to receive a pair of FIG. 2 guides.
Figure 7:
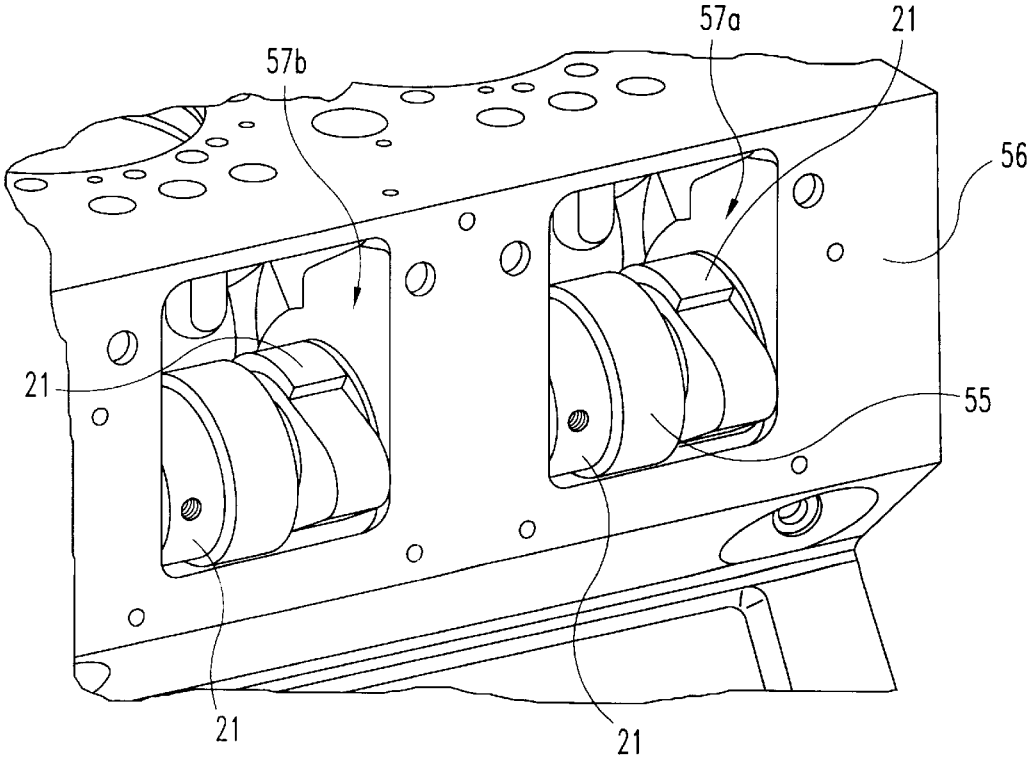
FIG. 7 is a partial, perspective, diagrammatic view of the FIG. 6 cylinder block with the FIG. 2 guides attached.

In order to properly place each of the guides 21 onto the inner base circle of each of the selected camshaft lobes, it will be necessary to rotate the camshaft. It is important to rotate the camshaft only when the camshaft bearing journals are in the cylinder block bushings. The camshaft should not be rotated when the camshaft guides are in the bushings. Adjust the camshaft guides until the camshaft lobe is in the middle of the camshaft guide opening. Performing this step requires that each camshaft guide 21 be rotated (slightly) so that its free ends 28 and 29 are located approximately at equal distances from the center of the cam lobe. Further, the camshaft guides 21 should fit flush with the camshaft journal and remain substantially concentric with it. The installation procedure for the guides 21 onto the camshaft lobes is illustrated in FIGS. 6 and 7. The representative camshaft 55 is positioned within the representative cylinder block 56. Follower openings 57*a* and 57*b* provide access to the lobes of the camshaft for receiving the snap-on guides 21.

Figure 8:
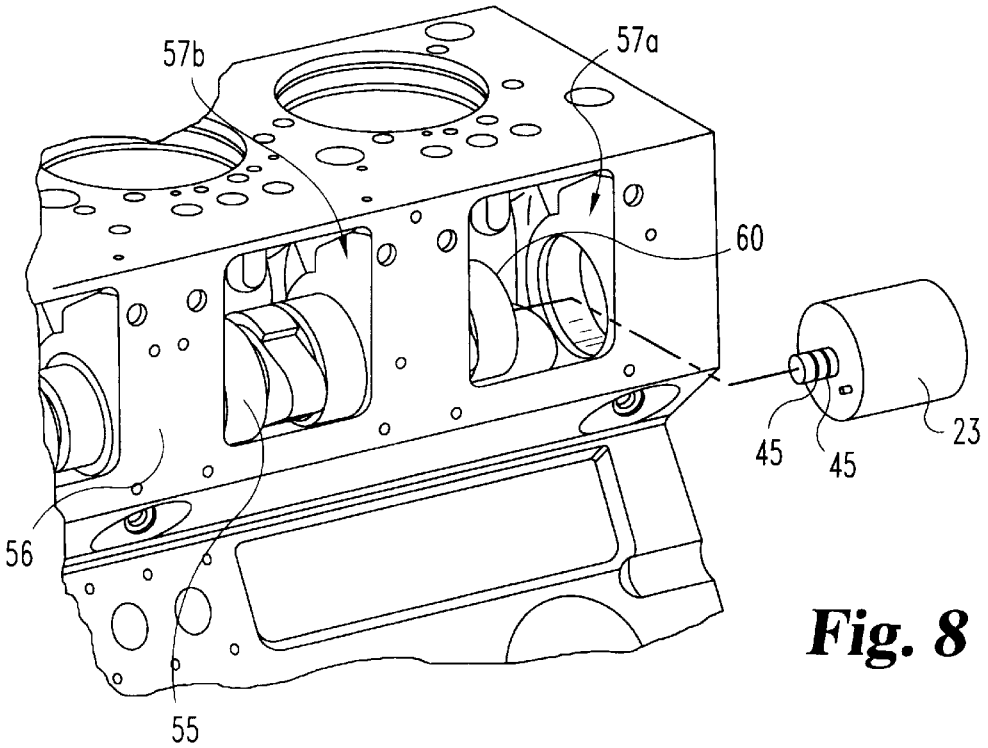
FIG. 8 is a partial, perspective, diagrammatic view showing the attachment of the FIG. 5 pilot to a rear face of the FIG. 6 camshaft.

The next step in the removal procedure is to install the pilot 23 by attaching it to the rear face 60 of camshaft 55. Prior to installing pilot 23, the two O-rings 45 should be lubricated. Additionally, during camshaft removal, it is important to keep the camshaft key way in the twelve o'clock position. The attachment of pilot 23 to rear face 60 is illustrated in FIG. 8. In order to complete this step, it is necessary to begin carefully sliding the camshaft 55 out of the camshaft bore within cylinder block 56. This sliding step should be stopped once there is free access to the rear face 60 of the camshaft through the first camshaft follower opening 57*a*. For the QSK45 engine (6 cylinders), this particular camshaft follower opening is referenced as the number 6 opening. For the QSK60 engine (8 cylinders), this first camshaft follower opening is referenced as the number 8 opening.

The pilot 23 is attached to rear face 60 by means of the cooperative combination of spacers 44, O-rings 45, rod 43, and nut 46. The dowel pin 48 is inserted into an alignment hole which is located in the rear face 60 of the camshaft. As hex nut 46 is tightened onto the threaded end of the rod 43, the two O-rings 45 are compressed between the spacers 44 and expand. While a minimum of two O-rings 45 and two spacers 44 are believed to be necessary, three or four of each could be used. The pilot is securely anchored to the camshaft in this manner. The torque to be applied to the hex nut 46 is approximately 18 foot-pounds.

It is important not to rotate the camshaft 55 during removal from the cylinder block 56 because the camshaft guides 21 which have been applied can become wedged and thereby make removal more difficult. While the camshaft should not be rotated, it is permissible to slightly wiggle the camshaft if that becomes necessary as part of the sliding out procedure. The sliding out step should then continue until the camshaft 55 is approximately half way (or slightly more than half way) out of the cylinder block 56 (see FIG. 9). As the camshaft 55 is removed from the cylinder block 56, the camshaft guides 21 that are free from the cylinder block can be removed and then reapplied to other camshaft lobes which are still positioned within the cylinder block, if desired.

Figure 9:
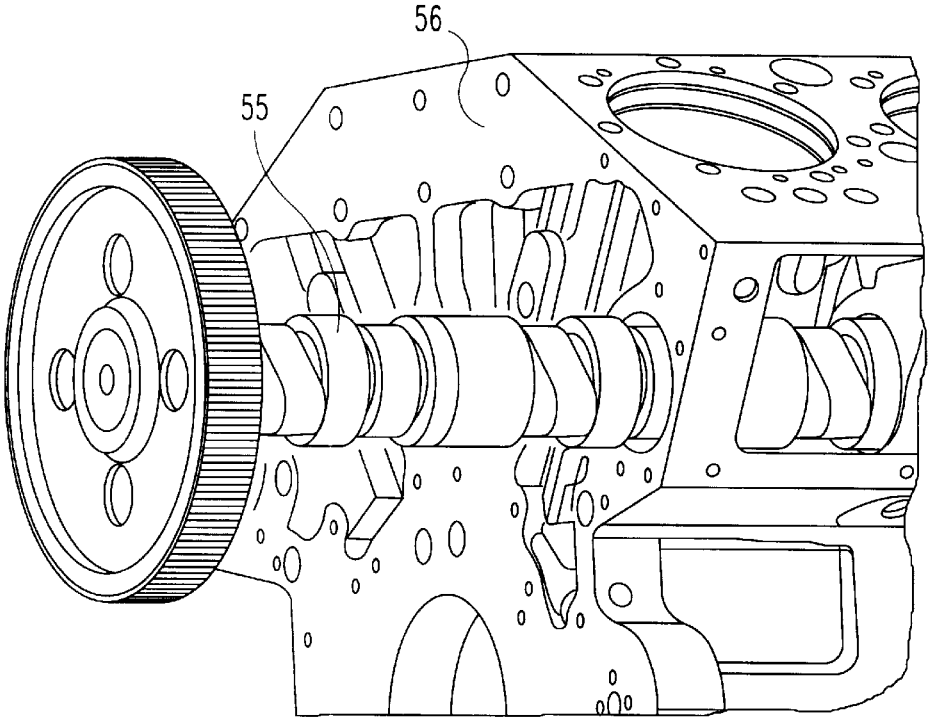
FIG. 9 is a partial, perspective, diagrammatic view of the FIG. 6 camshaft as being removed from the FIG. 6 cylinder block.
Figure 10:
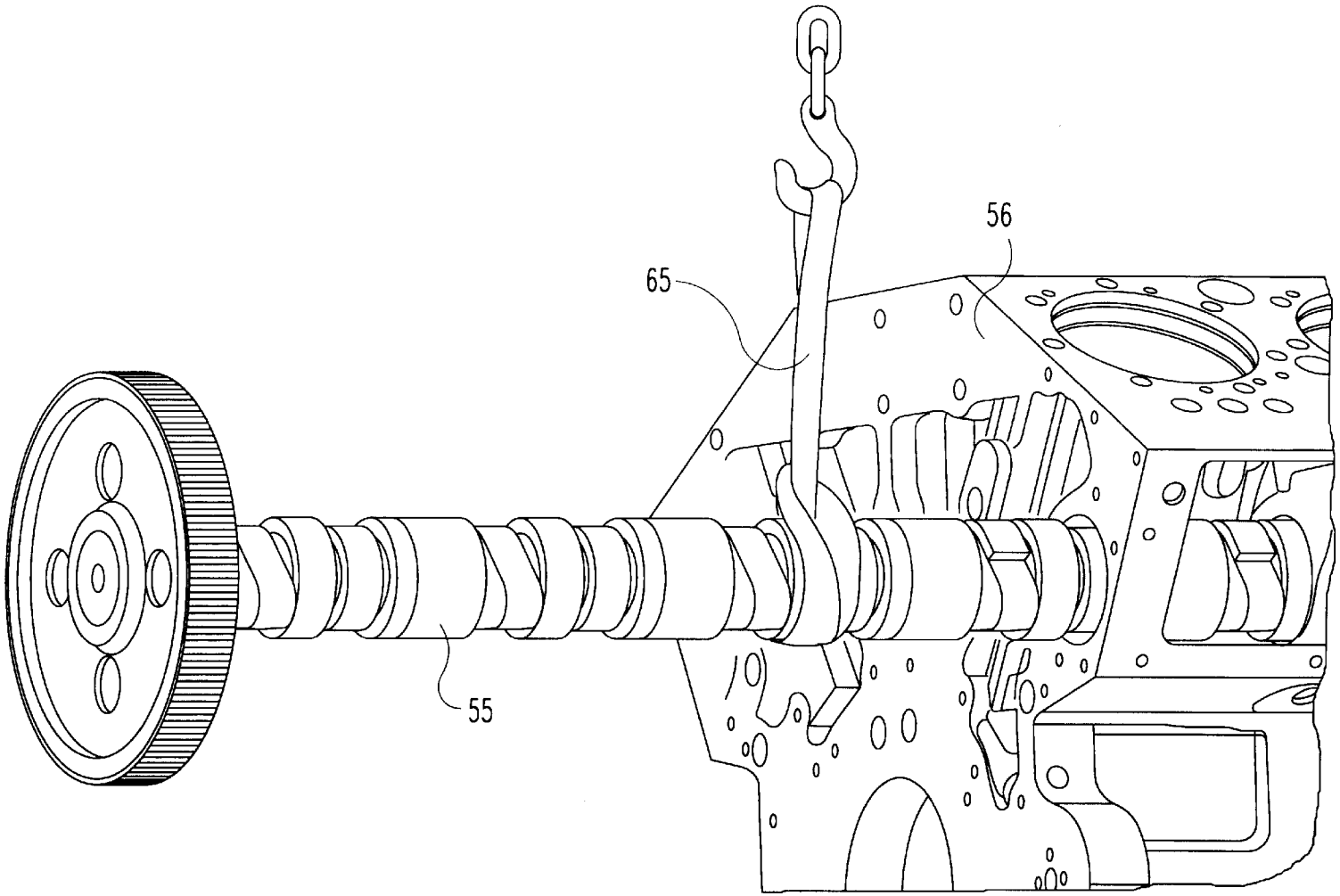
FIG. 10 is a partial, perspective, diagrammatic view of a lifting strap being attached to the FIG. 9 camshaft as it slides out from within the FIG. 6 cylinder block.

Since the camshaft 55 is quite heavy and several feet in length, it is necessary to provide additional support as the remainder of the camshaft slides out of the cylinder block. Once the camshaft is approximately half way out of the cylinder block, a lifting strap 65 is wrapped around the camshaft in order to provide additional support. The "lifting" strap is actually used to just steady and support the camshaft 55 as it slides out of the cylinder block 56. Actually lifting the camshaft too much or allowing it to drop down too much will result in binding up of the camshaft in the camshaft bore in the cylinder block. It is important to use the lifting strap 65 to keep the camshaft horizontally aligned with the bores so that the camshaft can be extracted from the cylinder block without binding. By waiting until the camshaft is approximately half way out of the cylinder block, it is possible to locate the lifting strap at a point roughly at the center of the overall length for the camshaft and this helps to balance the camshaft. If the camshaft is not balanced with the lifting strap, there is a greater tendency for it to tip one direction or the other and cause the camshaft to bind up. The extraction of the camshaft from the cylinder block and the attachment of the lifting strap 65 are illustrated in FIGS. 9 and 10.

Figure 11:
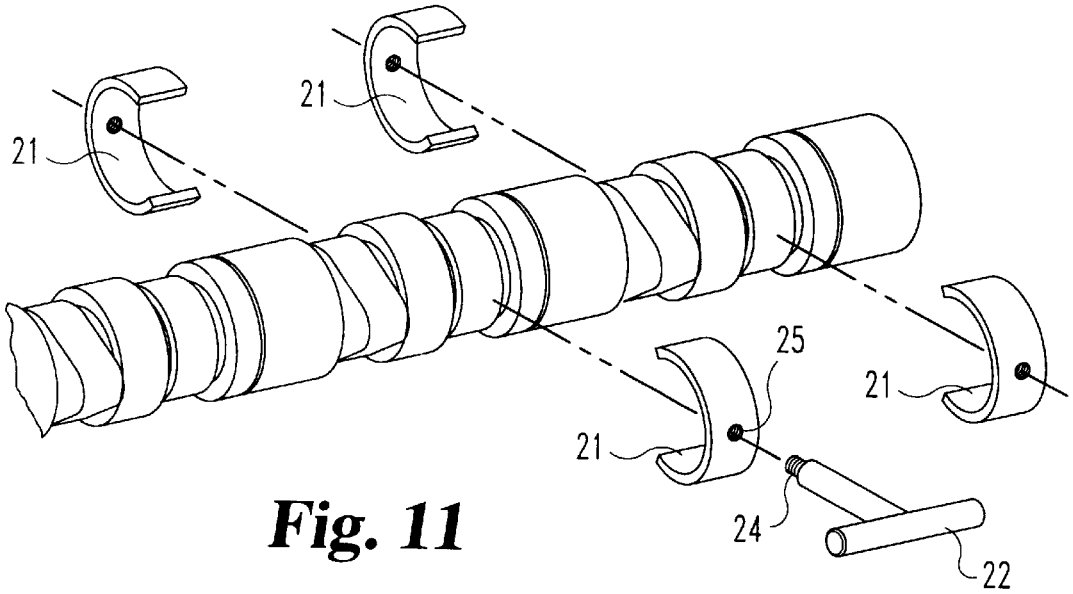
FIG. 11 is a partial, perspective, diagrammatic view of the FIG. 2 guides being removed from the FIG. 6 camshaft by means of the FIG. 4 guide extractor.

Once the camshaft is completely free of the cylinder block, those camshaft lobe guides 21 which have not already been removed are then removed so that the camshaft can be serviced, overhauled, or repaired, whatever is desired. Whether the guides have been removed during the removal process or are removed after the camshaft is free of the cylinder block, the extractor 22 is used for the removal procedure. The guide extractor has a handle portion for manual use and a threaded end 24 which fits into the internally-threaded hole 25 in each guide. All that is required, as illustrated in FIG. 11, is to thread the tip of the guide extractor into the corresponding guide hole and then use this threaded engagement for manually pulling the guide off of the corresponding camshaft lobe.

Figure 12:
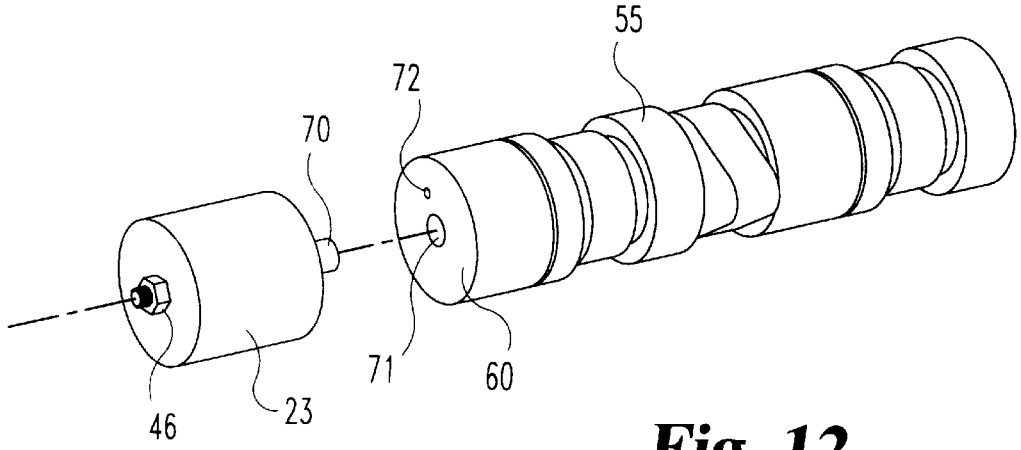
FIG. 12 is a partial, perspective, diagrammatic view of the FIG. 5 pilot being removed from the FIG. 6 camshaft.

In FIG. 12, the removal procedure for the pilot 23 is illustrated. Since an O-ring expansion principle has been used to wedge the tip 70 of the pilot 23 into hole 71 in the rear face 60, the first step in order to loosen the connection between the pilot and rear face 60 is to loosen hex nut 46. Once the nut is loosened, the compression of the O-rings is relaxed and the pilot can be pulled from the rear face 60. In the FIG. 12 illustration, the dowel pin hole 72 is illustrated which was not previously able to be illustrated due to the orientation selected for the corresponding drawing figures. The dowel pin hole 72 was originally used by shaft manufacturers to facilitate the grinding operation of the camshaft. This hole can now be made use of to precisely locate the pilot 23.

Figure 13:
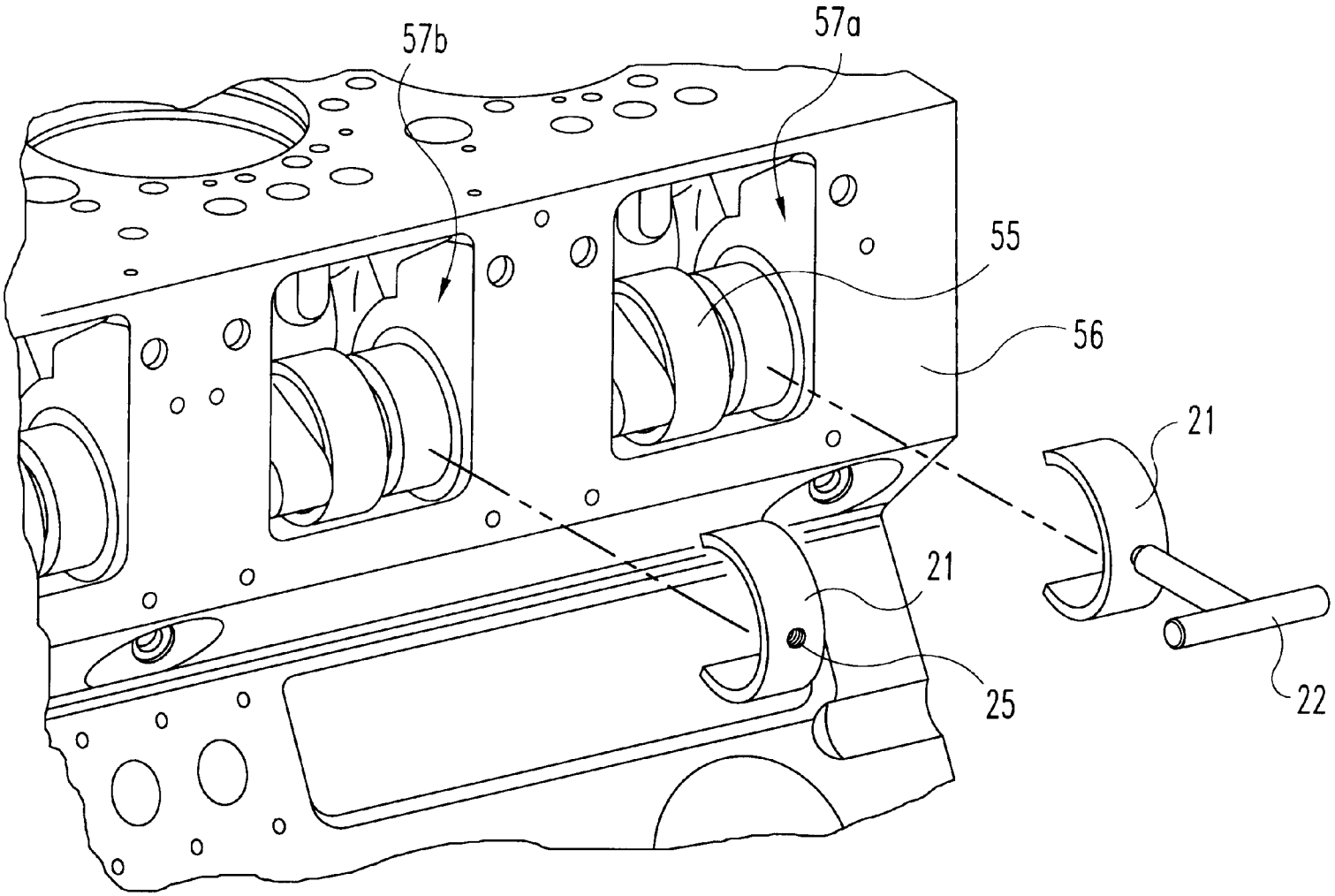
FIG. 13 is partial, perspective, diagrammatic view of the guide removal procedure after installation of a camshaft into a cylinder block according to the present invention.

As would be understood, the camshaft installation procedure basically involves the removal steps in reverse order. To begin, make certain that the camshaft 55, camshaft lobe guides 21 and pilot 23 are free of lubricant and debris. Dirt particles on the inside diameter of the camshaft guides and the cam lobes during installation can scratch the surface of the camshaft, causing performance degradation or damage to the engine. As before, it is important not to lubricate the inner diameter of the camshaft guides, but rather lubricate the outside diameter after the guides are installed on the corresponding camshaft lobes. As the camshaft 55 slides into the cylinder block 56, the guides 21 will ultimately be removed by use of the extractor 22 in the reverse order to which they were initially installed, as illustrated in FIG. 13.

While it has been indicated that the installation procedure is the reverse of the removal procedure, it should be understood that this encompasses all of the removal steps, including use of the lifting strap as well as all of the precautionary notes. This would also involve installation of the guides on the same camshaft lobes based on the particular camshaft and the particular style of engine as previously represented in Table I.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A kit for both removal of a camshaft from a cylinder block and for installation of a camshaft into a cylinder block, said kit comprising:

a plurality of camshaft guides wherein each guide is constructed and arranged to fit onto a corresponding camshaft lobe;

an extraction tool which is constructed and arranged for connection to each camshaft guide of said plurality of camshaft guides in order to facilitate removal of said plurality of camshaft guides from said camshaft lobes; and a pilot which is constructed and arranged for connection to a rear face of the camshaft wherein the pilot provides additional support to the camshaft during removal and during installation.

2. The kit of claim 1 wherein each camshaft guide of said plurality of camshaft guides includes a C-shaped body.

3. The kit of claim 2 wherein each camshaft guide of said plurality of camshaft guides further includes a threaded hole.

4. The kit of claim 3 wherein said extraction tool includes a handle and a threaded tip, said threaded tip being constructed and arranged to threadedly engage said threaded hole.

5. The kit of claim 4 wherein said pilot includes a body portion and a rod inserted into said body portion, said rod having a first end extending beyond a first end of said body portion and a threaded second end extending beyond a second end of said body portion.

6. The kit of claim 5 wherein said pilot further includes a spacer positioned between said first end of said rod a nd said first end of said body portion.

7. The kit of claim 6 wherein said pilot further includes an O-ring positioned between said first end of said rod and said first end of said body portion.

8. The kit of claim 7 wherein said pilot further includes a dowel pin assembled into and extending outwardly away from said first end of said body portion.

9. The kit of claim 1 wherein each camshaft guide of said plurality of camshaft guides further includes a threaded hole.

10. The kit of claim 9 wherein said extraction tool includes a handle and a threaded tip, said threaded tip being constructed and arranged to threadedly engage said threaded hole.

11. The kit of claim 1 wherein said pilot includes a body portion and a rod inserted into said body portion, said rod having a first end extending beyond a first end of said body portion and a threaded second end extending beyond a second end of said body portion.

12. The kit of claim 11 wherein said pilot further includes a spacer positioned between said first end of said rod and said first end of said body portion.

13. The kit of claim 12 wherein said pilot further includes an O-ring positioned between said first end of said rod and said first end of said body portion.

14. The kit of claim 13 wherein said pilot further includes a dowel pin assembled into and extending outwardly away from said first end of said body portion.

* * * * *

UNITED STATES PATENT AND TRADEMARK OFFICE

CERTIFICATE OF CORRECTION

PATENT NO. : 6,434,809 B1
DATED : August 20, 2002
INVENTOR(S) : Ram B. Khurana

It is certified that error appears in the above-identified patent and that said Letters Patent is hereby corrected as shown below:

Column 8,
Line 13, delete "a nd" and insert -- and --.

Signed and Sealed this

Thirty-first Day of December, 2002

JAMES E. ROGAN
*Director of the United States Patent and Trademark Office*